United States Patent [19]

Herron, Jr. et al.

[11] Patent Number: 4,864,683

[45] Date of Patent: Sep. 12, 1989

[54] NOISE ISOLATING MOTOR MOUNTING SYSTEM FOR A CANISTER VACUUM CLEANER

[75] Inventors: Roy H. Herron, Jr., Starr; William R. Sumerau, Easley, both of S.C.

[73] Assignee: Ryobi Motor Products Corp., Pickens, S.C.

[21] Appl. No.: 288,969

[22] Filed: Dec. 23, 1988

[51] Int. Cl.[4] ..... A47L 9/22

[52] U.S. Cl. ..... 15/412; 15/326; 181/207; 248/638; 310/51; 417/363

[58] Field of Search ..... 15/326, 412; 310/51; 181/231, 207; 417/363; 248/638

[56] References Cited

U.S. PATENT DOCUMENTS

| | | | |
|---|---|---|---|
| 1,832,368 | 11/1931 | Ell | 417/363 X |
| 2,036,058 | 3/1936 | Lang | 417/363 |
| 2,136,268 | 11/1938 | Watts | 310/51 X |
| 2,570,222 | 10/1951 | Ell | 15/412 X |
| 2,991,928 | 7/1961 | Bramhall | 417/363 X |
| 3,339,867 | 9/1967 | Bayless | 417/363 X |
| 4,597,131 | 7/1986 | Lyman | 15/412 |
| 4,632,642 | 12/1986 | Meister et al. | 310/51 X |
| 4,819,503 | 4/1989 | Fazi et al. | 310/51 X |

*Primary Examiner*—Chris K. Moore

*Attorney, Agent, or Firm*—David L. Davis

[57] ABSTRACT

An arrangement for mounting a motor blower assembly in a canister vacuum cleaner uses a pair of resilient rubber rings, one each on the front and rear of the assembly, to isolate the motor from the vacuum cleaner housing. The front ring goes over the front of the fan casing and is trapped within the housing, while the rear of the motor has attached thereto an adaptor which fits within the complementarily shaped rear rubber ring. This rear rubber ring in turn fits within a complementarily shaped motor support, which is attached to a support abutment within the housing. In order to accommodate different size motors within the same housing and utilize the same mounting components, the support abutment is pre-drilled at various locations to accommodate the different size motors. Thus, the only fixed attachment to the housing is the rear support, which is isolated from the motor blower assembly by the rear rubber ring.

4 Claims, 1 Drawing Sheet

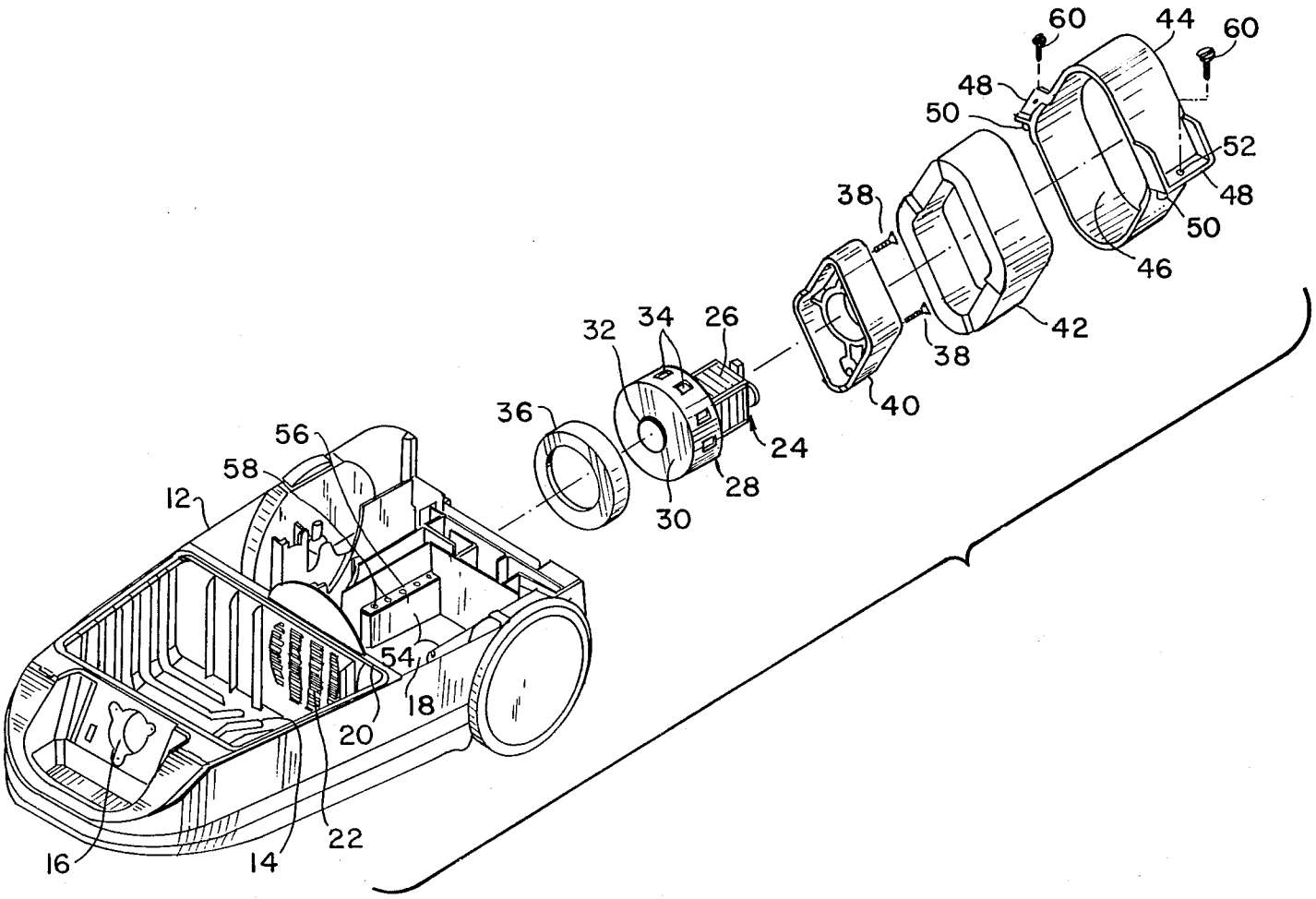
60
52
48
50
44
46
60
42
48
50
38
38
40
24
26
28
34
30
32
36
18
54
20
22
56
14
58
12
16

NOISE ISOLATING MOTOR MOUNTING SYSTEM FOR A CANISTER VACUUM CLEANER

BACKGROUND OF THE INVENTION

This invention relates to vacuum cleaners and, more particularly, to an arrangement for mounting a motor blower assembly in a canister vacuum cleaner housing so as to isolate from the housing vibrations generated by the motor blower assembly.

The desirability of isolating the motor blower assembly of a canister vacuum cleaner from the housing of the vacuum cleaner in order to reduce the transmission of noise is in general known. It is also generally known that the use of rubber or a similar resilient material in the mounting structure is advantageous for this purpose.

When designing a line of canister vacuum cleaners with different models having different features, it is desirable for the sake of economy to have as much commonality of parts as possible between the various models. Typically, however, different models within a line of canister vacuum cleaners have different size motors as part of the motor blower assembly.

It is therefore an object of the present invention to provide an arrangement for mounting the motor blower assembly of a canister vacuum cleaner to both provide vibration isolation and commonality of parts to accommodate different size motors.

SUMMARY OF THE INVENTION

The foregoing and additional objects are attained in accordance with the principles of this invention by providing a motor blower assembly mounting arrangement comprising a pair of resilient rubber rings, one each on the front and rear of the motor blower assembly to isolate the assembly from the vacuum cleaner housing. The front ring goes over the front of the fan casing and is trapped between the housing and the casing. The rear of the motor has attached thereto an adaptor member which fits within the complementarily shaped rear rubber ring. This rear rubber ring in turn fits within a complementarily shaped motor support. The motor support is fastened to the vacuum cleaner housing. The only fixed attachment to the housing is the rear motor support, which is isolated from the motor by the rear rubber ring. The front and rear rings as well as the motor support are interchangeable for different size motor blower assemblies, with only the adaptor member being designed for a specific size motor blower assembly.

BRIEF DESCRIPTION OF THE DRAWINGS

The foregoing will be more readily apparent upon reading the following description in conjunction with the drawing in which the single FIGURE is an exploded perspective view illustrating the inventive mounting arrangement for the motor blower assembly in a canister vacuum cleaner.

DETAILED DESCRIPTION

Referring now to the drawing, the single FIGURE thereof shows a canister vacuum cleaner housing with the top cover removed and the motor blower assembly with its mounting arrangement. Thus, the canister vacuum cleaner includes a housing lower portion 12 which, together with a cover portion (not shown), forms an enclosure for the components of the vacuum cleaner. The housing portion 12 has a plurality of walls which divide the enclosure into a plurality of compartments. One of the compartments is a dust collecting compartment 14 which typically includes provision for holding a disposable filter bag. As is well known, the dust collecting compartment 14 has an opening 16 into which is inserted the end of a hose for admitting dirt laden air into the interior of the filter bag. A second compartment in the vacuum cleaner is a suction compartment 18 in which the motor blower assembly is mounted, as will be described in detail hereinbelow. The dust collecting compartment 14 and the suction compartment 18 are separated by a wall 20 having a plurality of apertures 22 within a defined region to allow air to pass from the dust collecting compartment 14 to the suction compartment 18. All of the foregoing is conventional in the vacuum cleaner art.

As is also conventional, suction for the vacuum cleaner is produced by a motor blower assembly 24 which includes an electric motor 26 connected to drive a fan within a casing 28. The fan within the casing 28 and the motor 26 are aligned longitudinally along the rotational axis of the motor 26. The casing 28 has a generally flat surface region 30 transverse to the motor axis at the end opposite the motor 26. An intake port 32 extends into the casing 28 through the surface region 30. A plurality of exhaust ports 34 extend into the casing 28 through a peripheral wall of the casing 28. Thus, in a conventional manner, the motor drives the fan to create suction at the intake port 32, with the exhausted air leaving through the exhaust ports 34.

The present invention provides an improved arrangement for mounting the motor blower assembly 24 within the suction compartment 18 in such a manner that vibration isolation is achieved between the motor blower assembly 24 and the housing 12. In accordance with this invention, there is provided an annular ring member 36 made of resilient material such as rubber. In cross-section, the ring member 36 is L-shaped, and is sized to fit snugly over the fan casing 28, leaving the intake port 32 and the exhaust ports 34 exposed.

Fixedly mounted on the back of motor 26, by screws 38 or the like, is a rigid adaptor member 40 whose interior configuration is specific to the motor 26 on which it is mounted, while its exterior configuration is predetermined and is independent of the parameters of the motor 26. The reason for this is that while different models of vacuum cleaner may have different size motors, it is desirable to have one mounting arrangement and housing configuration.

Fitted over the adaptor member 40 is a motor ring 42 made of resilient material such as rubber. The interior shape and size of the ring 42 is complemental to the predetermined exterior shape and size of the adaptor member 40. The motor ring 42 also has a predetermined and fixed exterior shape and size so that it is interchangeable independent of the particular motor being used.

There is further provided a rigid motor support member 44 having a cavity 46 shaped and sized complemental to the exterior of the motor ring 42. The motor support member 44 is fitted over the motor ring 42 and is of a predetermined fixed size independent of the particular motor size. The support member 44 is formed with a pair of planar parallel wings 48 which extend from opposite sides thereof. Each of the wings 48 has a projection 50 extending transverse to the plane of the wings 48 and parallel to each other. Each of the wings 48 is further formed with an aperture 52.

To install the motor blower assembly 24, the adaptor member 40 is secured to the back of the motor 26 by the screws 38 going through suitably positioned apertures in the member 40 and threadedly engaging threaded holes on the motor structure. The motor ring 42 is then fitted over the adaptor member 40 and the motor support member 44 is fitted over the motor ring 42. The ring member 36 is then fitted over the front end of the fan casing 28 and the entire assembly may then be dropped into the suction compartment 18. To fixedly secure this assembly within the suction compartment 18, the suction compartment 18 is provided with a pair of support abutments 54 therein. Each of the support abutments 54 has a planar support surface 56 at its upper end with a plurality of bores 58 extending into the abutment 54 transverse to the support surface 56. The bores 58 are sized to accommodate therein the projections 50 and are spaced along the longitudinal axis of the motor blower assembly so that different size motors may be accommodated. Some of the bores 58 are internally threaded so that after the assembly is placed in the suction compartment 18 with the projections 50 within respective bores 58, threaded screws 60 may be inserted through the apertures 52 and threaded into respective ones of the bores 58 to fixedly secure the motor support member 44.

When the aforedescribed motor blower assembly and mounting arrangement is installed in the suction compartment, the projections 50 are inserted into appropriate ones of the bores 58 so that the ring member 36 abuts the wall 20. At least some of the apertures 22 are exposed by the opening of the ring member 36 so that there is free communication between the apertures 22 and the intake port 32. The bores 58 are appropriately spaced from the wall 20 so that the ring member 36 is in compression between the wall 20 and the fan casing 28 to form a seal between the apertures 22 and the remainder of the suction compartment 18. The screws 60 then secure the mounting arrangement. The top cover (not shown) is then installed on the housing lower portion 12 and is so shaped as to trap the ring member 36 and the fan casing 28 to complete the seal.

As is apparent from the foregoing, the motor blower assembly 24 is isolated from the housing 12 by the resilient ring member 36 and the resilient motor ring 42. Only the motor support member 44 is fixedly secured to the housing 12, and this is isolated from the motor blower assembly 24. The adaptor member 40, the motor ring 42 and the support member 44 are of non-circular configuration to prevent unwanted rotation of the motor blower assembly 24. The bores 58 in the abutments 54 are in linear arrays parallel to the rotational axis of the motor 26 and are appropriately spaced from the wall 22 so that different size motor blower assemblies 24 may be accommodated within the suction compartment 18.

Accordingly, there has been disclosed an improved mounting arrangement for a motor blower assembly in a canister vacuum cleaner. While a preferred embodiment of the present invention has been disclosed herein, it will be apparent to those of ordinary skill in the art that various modifications and adaptations to that embodiment are possible and it is only intended that the present invention be limited by the scope of the appended claims.

We claim:

1. In a vacuum cleaner having:

a housing forming an enclosure for the components of the vacuum cleaner and having a plurality of walls dividing the enclosure into a plurality of compartments, said plurality of compartments including at least a dust collecting compartment and a suction compartment, one of said plurality of walls separating said suction compartment from said dust collecting compartment, said one wall having apertures within a defined region to allow air to pass from said dust collecting compartment to said suction compartment; and an electric motor blower assembly including a fan and a motor, said fan and said motor being aligned longitudinally along the rotational axis of said motor, said fan being enclosed within a casing including an intake port and an exhaust port, said fan casing having a generally flat surface region transverse to said axis at the end opposite said motor, said intake port being located on said region, said motor driving said fan to create suction at said intake port;

an arrangement for mounting said motor blower assembly in said suction compartment, comprising:

an annular resilient ring member having a generally L-shaped cross-sectional configuration, said ring member being mounted on said fan casing opposite end, the opening of said ring member leaving said intake port exposed;

a rigid adaptor member fixedly mounted on said motor at the end opposite said fan, said adaptor member being configured to have a predetermined exterior noncircular shape and size and an interior shape and size which is dependent upon the particular motor on which it is mounted;

a resilient motor ring configured with an interior shape and size complemental to said predetermined exterior shape and size of said adaptor member and fitted over said adaptor member, the exterior of said motor ring being non-circular;

a rigid motor support member having a cavity shaped and sized complemental to the exterior of said motor ring and fitted over said motor ring; and securing means for fixedly securing said support member to said housing within said suction compartment so that said ring member is in abutting relation to said one wall in said defined region with at least some of said apertures being exposed by the opening of said ring member, said ring member being in compression between said one wall and said fan casing to form a seal between said apertures and said suction compartment outside said ring member.

2. The arrangement according to claim 1 wherein said securing means comprises:

a pair of planar parallel wings on said support member extending from opposite sides of said support member;

a projection on each of said wings, said projections extending parallel to each other transverse to the planes of said wings; and a pair of support abutments in said suction compartment, each of said abutments including a planar support surface and a bore transverse to said support surface for accommodating a respective one of said projections.

3. The arrangement according to claim 2 wherein each of said support abutments has a plurality of said bores in a linear array parallel to the rotational axis of said motor and spaced so that different size motors may be accommodated thereby.

4. The arrangement according to claim 2 wherein each of said wings is formed with an aperture and each of said abutments is formed with a further bore transverse to said support surface and further including a pair of threaded members each extending through a respective aperture to threadingly engage a respective further bore.

* * * * *